US007632147B2

(12) United States Patent
Farahani et al.

(10) Patent No.: US 7,632,147 B2
(45) Date of Patent: Dec. 15, 2009

(54) SHIELDED CABLE PLUG AND JACK ASSEMBLY

(75) Inventors: Fereidoun A. Farahani, Woodbridge, CT (US); William H. Flanagan, Stamford, CT (US)

(73) Assignee: Nexus, Incorporated, Stamford, CT (US)

( * ) Notice: Subject to any disclaimer, the term of this patent is extended or adjusted under 35 U.S.C. 154(b) by 0 days.

(21) Appl. No.: 12/042,031

(22) Filed: Mar. 4, 2008

(65) Prior Publication Data

US 2009/0227150 A1 Sep. 10, 2009

(51) Int. Cl.
*H01R 13/648* (2006.01)

(52) U.S. Cl. ..... 439/607.41; 439/387

(58) Field of Classification Search ..... 439/610, 439/393–395, 411, 412, 387, 415, 416, 578, 439/583, 607.45, 607.52, 607.41
See application file for complete search history.

(56) References Cited

U.S. PATENT DOCUMENTS

| | | | | |
|---|---|---|---|---|
| 3,074,045 | A | 1/1963 | Overholser | 339/177 |
| 3,264,602 | A * | 8/1966 | Schwartz | 439/578 |
| 3,907,395 | A | 9/1975 | Flanagan | 339/99 |
| 5,414,212 | A | 5/1995 | Clouet et al. | 174/36 |
| 5,470,257 | A | 11/1995 | Szegda | 439/578 |
| 5,508,475 | A | 4/1996 | Profiri et al. | 174/74 |
| 6,137,056 | A * | 10/2000 | Miyazaki | 174/78 |
| 6,497,587 | B2 * | 12/2002 | Di Mario | 439/578 |
| 6,659,140 | B2 | 12/2003 | Yamakawa | 140/71 |
| 6,682,360 | B2 * | 1/2004 | Schauer et al. | 439/323 |
| 6,848,939 | B2 | 2/2005 | Stirling | 439/578 |
| 2003/0003805 | A1 * | 1/2003 | Yamamoto | 439/610 |

* cited by examiner

*Primary Examiner*—Edwin A. Leon
*Assistant Examiner*—Vanessa Girardi
(74) *Attorney, Agent, or Firm*—St. Onge Steward Johnston & Reens LLC

(57) ABSTRACT

An electrical connector including a housing including an opening, a carrier assembly for receiving one or more leads from a wire assembly and extending via the opening, an annular gap between an inside surface of the opening and the carrier assembly, a shell including a hole for receiving the wire assembly, the shell adapted for slideable engagement with the housing in the annular gap, and wherein the slideable engagement between the shell and the housing severs a distal portion of a shield layer of the wire assembly and secures a proximal portion of the shield layer in the annular gap.

22 Claims, 6 Drawing Sheets

SHIELDED CABLE PLUG AND JACK ASSEMBLY

FIELD OF THE INVENTION

The invention relates to an electrical connector assembly, and more specifically to a multi-circuit electrical connector assembly for connecting shielded wire assemblies.

BACKGROUND OF THE INVENTION

Many different electrical connectors and multi-circuit electrical connectors are known. For example, commonly owned U.S. Pat. No. 3,907,395 to Flanagan discloses a multi-circuit electrical connector with an advantageous means for self-effectuating connection of the circuits. The connector disclosed in the Flanagan patent is adaptable for use with shielded wires. However, as with many other connectors, the shield layer of the wire must be measured and cut to length by hand before completing the assembly. This step adds significant time and labor to the assembly process.

U.S. Pat. No. 6,137,056 to Miyazaki discloses a construction for connecting a shield layer of a shielded cable. The construction includes an inner tubular member that is inserted inside an exposed portion of the shield layer, and a conductive outer tubular member fitted on the outside of the shield layer. The inner tubular member and the outer tubular member are pushed toward one another and engage. Assembly of the connector requires cutting the wire to expose the core and peeling back the sheath to expose the braided wire. The braided wire must then be cut off to avoid contact with the core.

U.S. Pat. No. 5,508,475 to Profiri et al. discloses a termination apparatus for a cable reinforced by a braided sheath. The apparatus includes a collar that is forced over a fitting. The braided sheath is forced over a flange and sheared off during assembly. Assembly requires expanding the end of the cable, e.g., with hydraulic jaws. Furthermore, the apparatus requires a securing channel adjacent to the collar with excess space to allow for the sheared material to be removed after assembly. The Profiri patent also does not disclose a termination apparatus adaptable for use with a wire assembly having an internal shield layer or an insulation layer.

What is desired is an electrical connector assembly with an improved means to secure a shield layer of a wire. What is also desired is such a electrical connector assembly with a simple means for self-effectuating connection of multiple circuits.

SUMMARY OF THE INVENTION

Accordingly, it is an object of the present invention to provide a multi-circuit electrical connector assembly with a means for securing a shield layer of a wire assembly and trimming the shield layer to length.

It is a further object of the present invention to provide a multi-circuit electrical connector that rigidly secures the shield layer of a wire assembly without risk of a disconnection. It is desired for such connector to also include two or more conductive portions in connect with the shield layer to ensure conductivity and/or grounding.

It is a further object of the present invention to provide such a multi-circuit electrical connector adaptable for use with wire assemblies including internal shield layers and also insulation layers.

These and other objectives are achieved by providing an electrical connector including a housing including an opening, a carrier assembly for receiving one or more leads from a wire assembly and extending via the opening, an annular gap between an inside surface of the opening and the carrier assembly, a shell including a hole for receiving the wire assembly, the shell adapted for slideable engagement with the housing in the annular gap, and wherein the slideable engagement between the shell and the housing severs a distal portion of a shield layer of the wire assembly and secures a proximal portion of the shield layer in the annular gap.

In some embodiments, the shell includes an outside surface with an annular protrusion and the inside surface of the opening includes at least one groove such that the annular protrusion engages the grove to secure the second end of the shell within the housing. Each of the housing and the shell may include a conductive material. The housing may include at least one of a male connection plug and a female connection jack.

Other objectives are achieved by providing an electrical connector including a carrier assembly including a series of longitudinally extending circumferentially spaced grooves, a housing circumscribing at least a portion of the carrier assembly, a shell adapted for cooperative engagement with the housing and the carrier assembly in an annular gap between the carrier assembly and the housing, contact members circumferentially positioned about the carrier assembly, each contact member including at least one barbed extension extending into at least one of the grooves, wherein the cooperative engagement of the shell and the housing severs a distal portion of a shield layer of the wire assembly and secures a proximal portion of the shield layer in the annular gap, and wherein the cooperative engagement of the shell with the carrier assembly compresses the leads into the barbed extensions to effectuate electrical continuity with the contact members.

Further provided is a method for assembling an electrical connector including the steps of providing a housing including a carrier assembly for receiving a plurality of leads from a wire assembly and extending from an opening of the housing, extending each of the plurality of leads into the carrier assembly, sliding a shell over the wire assembly and the carrier assembly and into an annular gap between an inside surface of the opening and the carrier assembly, wherein the sliding of the shell pushes a shield layer of the wire assembly over the carrier assembly and into the annular gap, and wherein an interface between the inside surface of the opening and an outside surface of the shell severs a distal portion of the shield layer and secures a proximal portion of the shield layer in the annular gap.

Other objects of the invention and its particular features and advantages will become more apparent from consideration of the following drawings and accompanying detailed description.

DETAILED DESCRIPTION OF THE INVENTION

Figure 1:
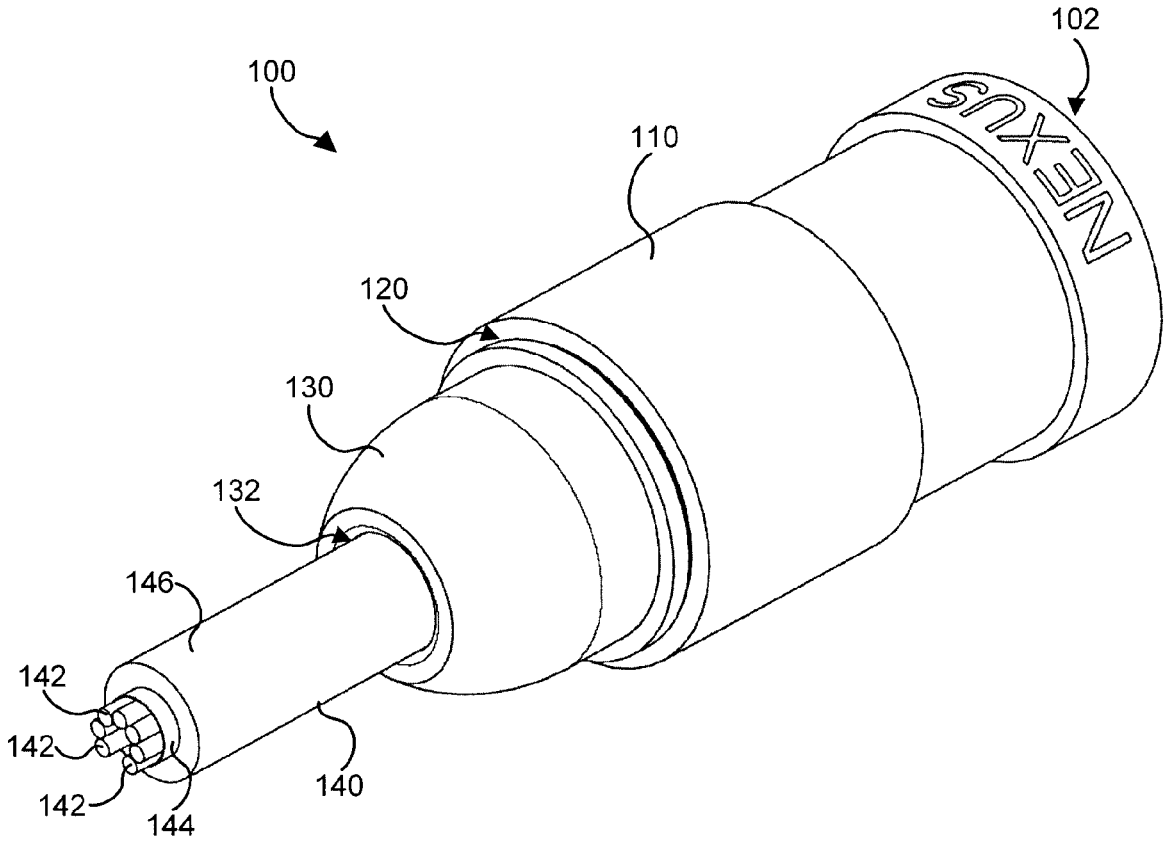
FIG. 1 is a perspective view of an electrical connector according to an exemplary embodiment of the present invention.
Figure 2:
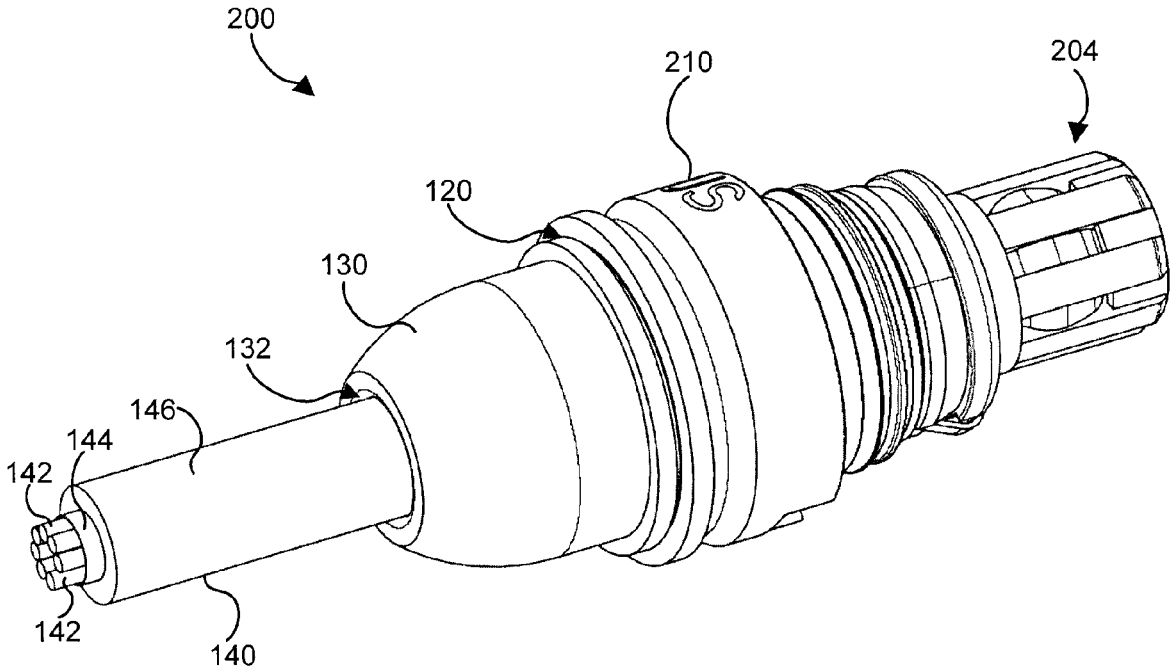
FIG. 2 is a perspective view of an electrical connector according to an exemplary embodiment of the present invention.
Figures 3A, 3B:
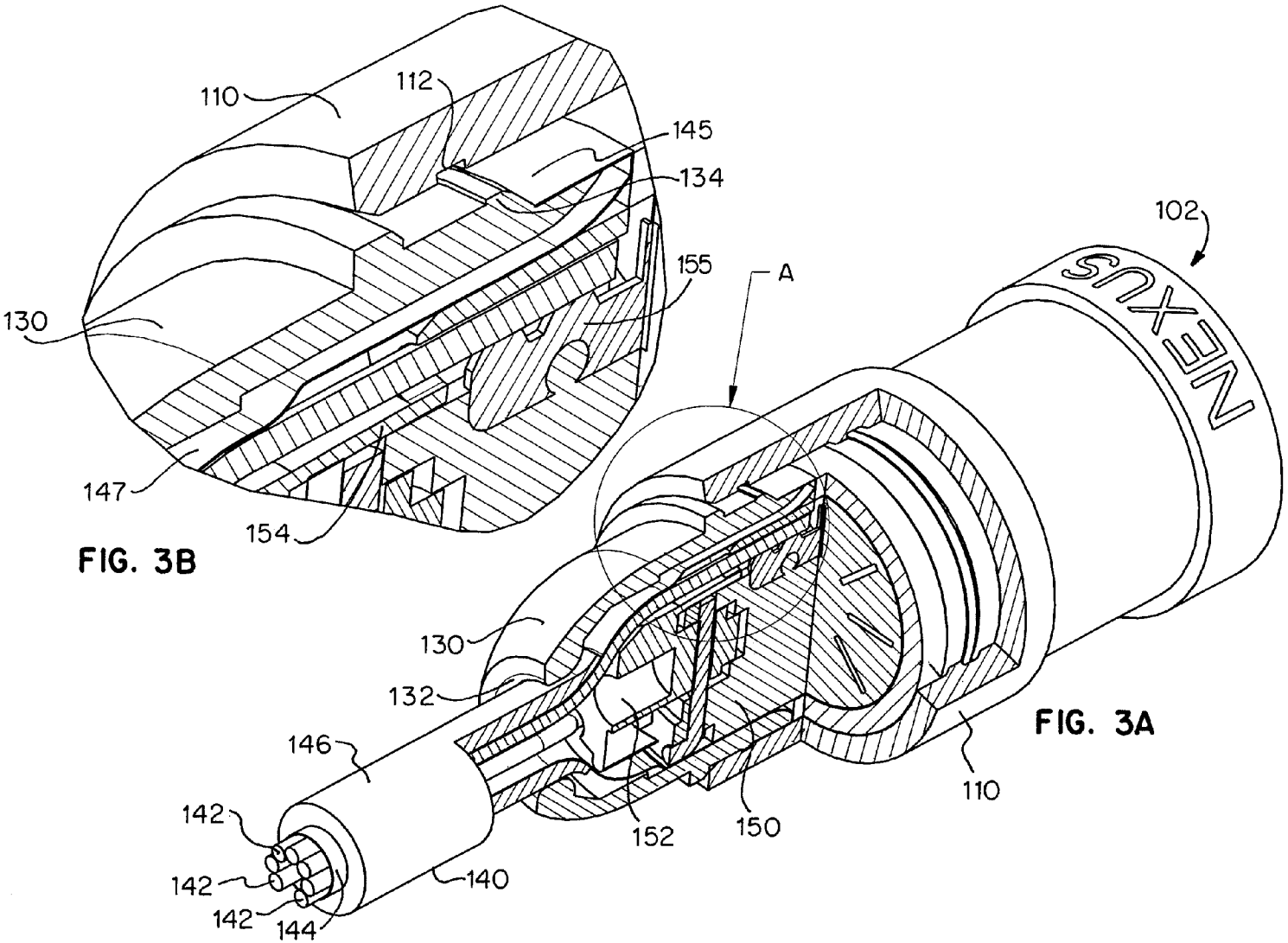
FIG. 3A is a cutaway perspective view of the electrical connector shown in FIG. 1.
FIG. 3B is a detail view (A) the electrical connector shown in FIG. 3A.
Figure 4B:
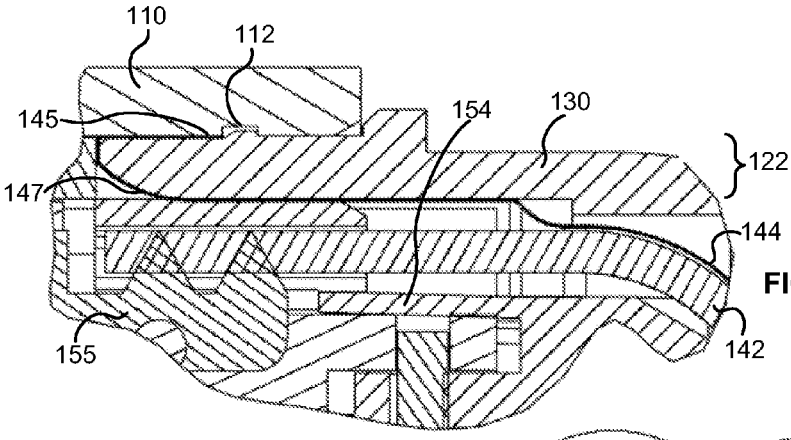
FIG. 4B is a detail view (B) of the electrical connector assembly shown in FIG. 4A.
Figure 4A:
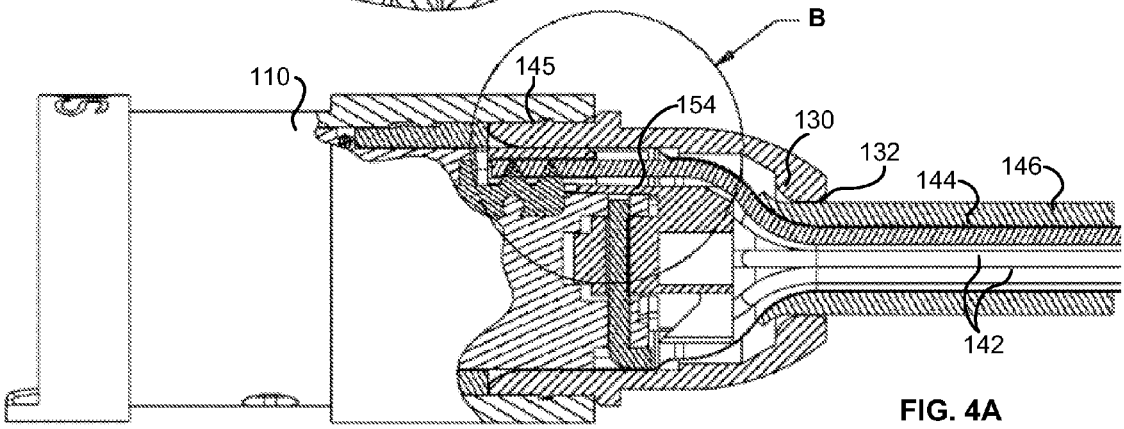
FIG. 4A is a cutaway side view of the electrical connector assembly shown in FIG. 1.
Figures 5A, 5B:
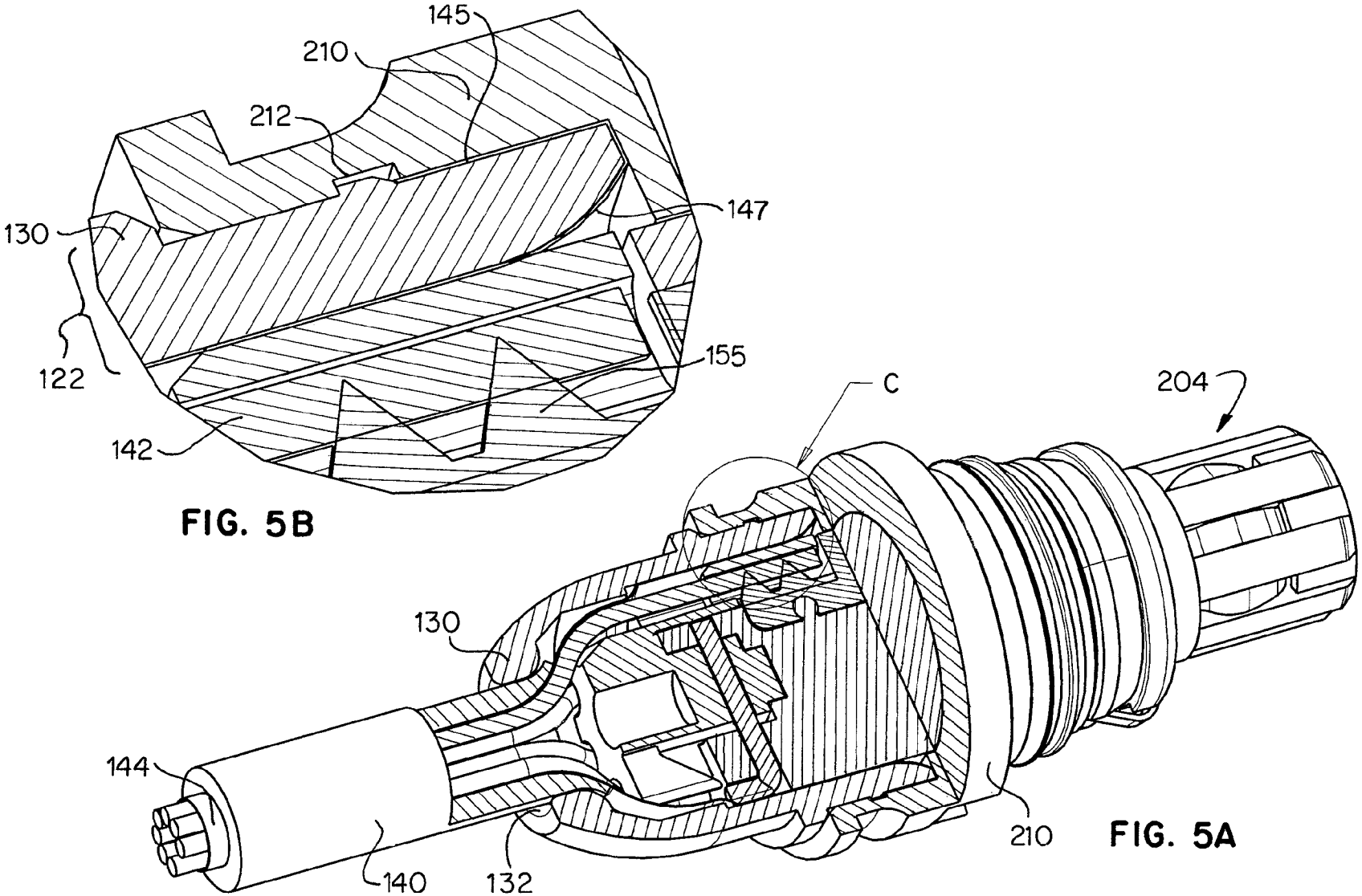
FIG. 5A is a cutaway perspective view of the electrical connector assembly shown in FIG. 2.
FIG. 5B is a detail view (C) the electrical connector shown in FIG. 5A.

FIG. 1 shows an electrical connector 100 according to an exemplary embodiment of the present invention. The connector 100 includes a female connection jack 102. FIG. 2 shows another electrical connector 200. The connector 200 includes a male connection plug 204. The connector 200 and connector 100 are adapted for self aligned snap engagement with each other.

As shown in FIGS. 1 and 2, the connector 100/200 includes a housing 110/210 with an opening 120. The connector 100/200 further includes a shell or cover 130. The shell 130 includes a hole or aperture 132 for receiving a wire assembly 140. The shell 130 is adapted for slideable engagement with the housing 110/210. In preferred embodiments, each of the shell 150 and the housing 110/210 are comprised of a conductive material. For example, the shell 150 and housing 110/210 may comprise aluminum.

Figure 6B:
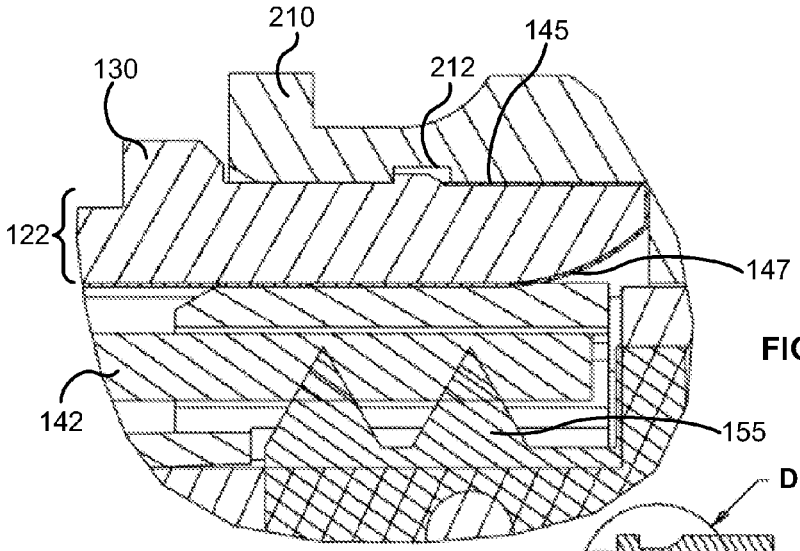
FIG. 6B is a detail view (D) of the electrical connector assembly shown in FIG. 6A.
Figure 6A:
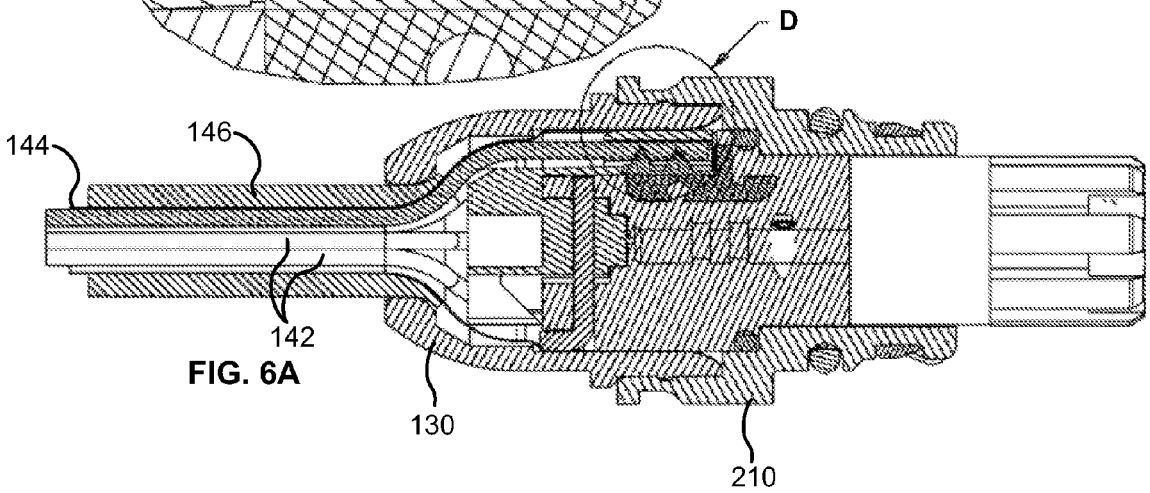
FIG. 6A is a cutaway side view of the electrical connector assembly shown in FIG. 2.

FIGS. 3A-6B show cutaway and detailed views of the connector 100/200 according to an exemplary embodiment of the present invention. The connector 100/200 includes a carrier assembly 150 extending via the opening 120 of the housing 110/210. As shown in FIGS. 4B, 5B and 6B, the connector 100/200 includes an annular gap 122 between an inside surface of the housing 110/210 and the carrier assembly 150. The shell 130 is slideable over the wire assembly 140 and into the annular gap 122.

The carrier assembly 150 receives one or more leads 142 from a wire assembly 140. In some exemplary embodiments, the connector 100/200 further includes a wiring harness 152 including a plurality of resilient arms 154. Each of the arms retains at least one of the leads 142. The wiring harness 152 is adapted for engagement with the carrier assembly 150 such that the arms 154 extend into circumferential grooves about the carrier assembly 150. One exemplary arrangement of the wiring harness 152 and carrier assembly 130 is illustrated in commonly owned U.S. Pat. No. 3,907,395, hereby incorporated by reference in its entirety.

The connector 100/200 according the present invention is adapted for use with wire assemblies 140 having a shield layer 144. The shield layer 144 may include, for example, a copper mesh material. However, any acceptable shield layer may be used. The shield layer 144 is disposed about the leads 142 in the wire assembly 140. The wire assembly 140 may also include an insulation layer 146 about the shield layer 144 or elsewhere in the wire assembly 140.

The shell 130 and housing 110/210 are adapted to sever a distal portion 145 of a shield layer 144 of the wire assembly 140 during engagement of the shell 130 and the housing 110/210. The shield layer 144 is pressed into the annular gap 122 by the shell 130 during assembly. The shield layer 144 need not be pre-cut and may be any length. A portion of the shield layer 140 extends in a first direction into the annular gap 122, and another portion (e.g., including a distal portion 145) extends in the opposite direction (e.g., towards the wire assembly 140). An interface between the inside surface of the housing 110/210 and the outside surface of the shell 130 then severs a distal portion 145 of the shield layer 144. For example, in some embodiments, the shell 130 includes at least one annular protrusion or ring 134 that engages at least one annular groove 112/212 on the inside surface of the housing 110/210. In some embodiments, the protrusion 134 includes one substantially sloped surface (e.g., for ease of engagement) and one substantially vertical surface (e.g., to restrict or prevent exit of the shell 130).

A proximal end 147 of the shield layer 144 remains secured in the annular gap 122. As illustrated in FIGS. 3B, 4B, 5B, and 6B, the shield layer 144 is secured between the inside surface of the housing 110/210 and the outside surface of the shell 130. The shield layer 144 is also at least partially secured between the carrier assembly 150 and/or arms 154 and an inside surface of the shell 130. Therefore, the shield layer 144 is rigidly secured in the connector 100/200 without risk of a disconnection. Furthermore, the shield layer 144 is secured against at least two conductive components including the housing 110/210 and the shell 130.

During engagement of the shell 130 and the housing 110/210, electrical connections between the leads 142 and the carrier assembly 150 may also be established or at least secured. For example, the carrier assembly 150 may include a plurality of contact members 155. At least a portion of the contact members 155, such as barbed extensions thereof, extends into the circumferential grooves about the carrier assembly 150. During engagement of the shell 130, the leads 142 are compressed into piercing engagement with at least one of the contact members 155.

Although the invention has been described with reference to a particular arrangement of parts, features and the like, these are not intended to exhaust all possible arrangements or features, and indeed many modifications and variations will be ascertainable to those of skill in the art.

What is claimed is:

1. An electrical connector, comprising:

a housing including an opening;

a carrier assembly for receiving one or more leads from a wire assembly and extending via the opening;

an annular gap between an inside surface of the opening and said carrier assembly;

a shell including a hole for receiving the wire assembly, said shell adapted for slideable engagement with said housing in said annular gap; and wherein the slideable engagement between said shell and said housing severs a distal portion of a shield layer of the wire assembly and secures a proximal portion of the shield layer in the annular gap.

2. The electrical connector according to claim 1, wherein the wire assembly includes a plurality of leads;

wherein said carrier assembly comprises a plurality of contact members; and wherein said shell compresses each of the plurality of leads into piercing engagement with at least one of the contact members when said shell is in slideable engagement with said housing.

3. The electrical connector according to claim 1, wherein upon the slideable engagement the distal portion of the shield layer points in a direction substantially opposite to the direction in which said shell and said housing are slideably engaged.

4. The electrical connector according to claim 1, wherein each of said housing and said shell comprise a conductive material.

5. The electrical connector according to claim 1, wherein said housing comprises a male connection plug.

6. The electrical connector according to claim 1, wherein said housing comprises a female connection jack.

7. The electrical connector according to claim 1, wherein the shield layer is disposed about the one or more leads, wherein the wire assembly further includes an insulation layer about the shield layer.

8. The electrical connector according to claim 1, wherein said shell includes an outside surface with an annular protrusion;

wherein the inside surface of the opening includes at least one groove; and wherein the annular protrusion engages the grove to secure said shell within said housing.

9. The electrical connector according to claim 8, wherein the distal portion of the shield layer is severed between the groove and the annular protrusion.

10. The electrical connector according to claim 8, wherein the outside surface of said shell further includes a second annular protrusion, the second annular protrusion abutting an end surface of said housing.

11. The electrical connector according to claim 1, wherein said carrier assembly further comprises:

a series of longitudinally extending circumferentially spaced grooves;

contact members circumferentially positioned about said carrier assembly and at least partially extending into the grooves;

a wiring harness including a series of arms for retaining the leads; and wherein each of the arms slideably engages into at least one of the grooves.

12. The electrical connector according to claim 11, wherein cooperative engagement of said shell with said carrier assembly compresses the leads into piercing engagement with the contact members to effectuate electrical continuity.

13. An electrical connector, comprising:

a housing including an opening;

a carrier assembly for receiving one or more leads from a wire assembly and extending via the opening;

an annular gap between an inside surface of the opening and said carrier assembly;

a shell including a hole for receiving the wire assembly, said shell adapted for slideable engagement with said housing in said annular gap;

wherein the slideable engagement between said shell and said housing severs a distal portion of a shield layer of the wire assembly and secures a proximal portion of the shield layer in the annular gap; and wherein the shield layer is secured adjacent to each of the inside surface of the opening, an inside surface of said shell, and an outside surface of said shell.

14. An electrical connector, comprising:

a carrier assembly including a series of longitudinally extending circumferentially spaced grooves;

a housing circumscribing at least a portion of said carrier assembly;

a shell adapted for cooperative engagement with said housing and said carrier assembly in an annular gap between said carrier assembly and said housing;

contact members circumferentially positioned about said carrier assembly, each contact member including at least one barbed extension extending into at least one of the grooves;

wherein the cooperative engagement of said shell and said housing severs a distal portion of a shield layer of a wire assembly and secures a proximal portion of the shield layer in the annular gap; and wherein the cooperative engagement of said shell with said carrier assembly compresses leads of the wire assembly into the barbed extensions to effectuate electrical continuity with said contact members.

15. The electrical connector according to claim 14, further comprising:

a wiring harness including a plurality of arms for retaining the leads of the wire assembly; and wherein said wiring harness is adapted for engagement with said carrier assembly with the arms extending in the circumferential grooves.

16. The electrical connector according to claim 14, wherein each of said housing and said shell comprise a conductive material.

17. The electrical connector according to claim 14, wherein said housing comprises at least one of a male connection plug and a female connection jack.

18. The electrical connector according to claim 14, wherein said shell includes an outside surface with an annular protrusion;

wherein the inside surface of the opening includes at least one groove; and wherein the annular protrusion engages the grove to secure said shell within said housing.

19. A method for assembling an electrical connector, comprising the steps of:

providing a housing including a carrier assembly for receiving a plurality of leads from a wire assembly and extending from an opening of the housing;

extending each of the plurality of leads into the carrier assembly;

sliding a shell over the wire assembly and the carrier assembly and into an annular gap between an inside surface of the opening and the carrier assembly;

wherein said sliding of the shell pushes a shield layer of the wire assembly over the carrier assembly and into the annular gap; and wherein an interface between the inside surface of the opening and an outside surface of the shell severs a distal portion of the shield layer and secures a proximal portion of the shield layer in the annular gap.

20. The method according to claim 19, wherein said step of extending each of the plurality of leads into carrier assembly includes extending each of the plurality of leads into a wiring harness adapted for axial engagement with the carrier and engaging the wiring harness with the carrier assembly.

21. The method according to claim 19, wherein, upon sliding the shell, the distal portion of the shielded layer points in a direction substantially opposite to the direction of the sliding.

22. The method according to claim 19, wherein an interface between an inside surface of the shell and the carrier assembly compresses the leads into piercing engagement with contact members of the carrier assembly to effectuate electrical continuity.

* * * * *